US007182035B1

(12) United States Patent
Palmer

(10) Patent No.: US 7,182,035 B1
(45) Date of Patent: Feb. 27, 2007

(54) BOAT SLIP STEP ASSEMBLY

(76) Inventor: Larry Palmer, 115 Settlers Rd., Harriman, TN (US) 37748

( * ) Notice: Subject to any disclaimer, the term of this patent is extended or adjusted under 35 U.S.C. 154(b) by 0 days.

(21) Appl. No.: 11/223,564

(22) Filed: Sep. 9, 2005

(51) Int. Cl.
*B63B 35/44* (2006.01)
*B63C 1/00* (2006.01)

(52) U.S. Cl. ..... 114/263; 405/219

(58) Field of Classification Search ..... 114/267, 114/263, 362; 405/219–221
See application file for complete search history.

(56) References Cited

U.S. PATENT DOCUMENTS 4,070,980 A * 1/1978 Shorter, Jr. ..... 114/263
4,930,184 A * 6/1990 Kristmanson ..... 16/273
6,230,644 B1 * 5/2001 Passen et al. ..... 114/263
6,845,845 B2 * 1/2005 Schmid, Jr. ..... 182/84

* cited by examiner

*Primary Examiner*—Jesús D. Sotelo
(74) *Attorney, Agent, or Firm*—Pitts & Brittian, P.C.

(57) ABSTRACT

A boat slip step assembly (10) for being mounted proximate the corner of a boat slip (16). The step assembly (10) includes at least one tread member (24) for being mounted in a corner of the boat slip (16) below the level of the upper surface of the boat dock (14) that defines the boat slip (16). The tread member (24) has a first edge portion (26) for being secured to a first dock section (20), and a second edge portion (28) for being secured to a second dock section (22).

20 Claims, 4 Drawing Sheets

BOAT SLIP STEP ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of Invention

This invention pertains to a step assembly for mounting in a boat slip to facilitate movement of an individual between the dock that defines the slip and a boat moored in the slip. More particularly, this invention pertains to a step assembly which is mountable in the corner of a slip, and which incorporates at least one tread member that is disposed at a level below the level of the upper surface of the dock.

2. Description of the Related Art

Boat docks are often provided with boat slips for mooring boats. A boat slip is typically defined by a boat dock having at least two dock sections that intersect to define a corner of the slip. Boat slips can also be defined by three dock sections such that the dock borders the slip on three sides, and the slip defines two corners. Whereas boat slips are provided to facilitate the movement of individuals between the dock defining the slip and boats moored at the dock, often the disparity in the height of the upper surface of the dock and the height of the deck of the boat can make such movement difficult. This disparity can be particularly pronounced where the dock is located in a body of water where there are significant shifts in the water levels due to tides, or due to artificial changes in water levels as is common in the case of reservoirs. Ladders secured to the dock have been used to provide a means for boat users to move between the dock and the deck of a boat, but ladders can be difficult to use, particularly for an individual who is carrying something, or an individual who does not have the necessary physical dexterity climb up or down a ladder. Moreover, such ladders are generally mounted on the portion of the dock which forms the side of the slip and can take up useful slip space, and also can be an undesirable obstacle when a boat is being pulled into the slip.

Therefore, there is a need for a device or apparatus which facilitates the movement of boat users between a dock defining a boat slip and the deck of a boat moored in the slip. There is also a need for such a device that does not require great physical dexterity to use, and which takes up little useable space in the boat slip.

BRIEF SUMMARY OF THE INVENTION

According to one embodiment of the present invention, a boat slip step assembly is provided for being mounted in or proximate the corner of a boat slip, the boat slip being defined by at least first and second dock sections that cooperatively define a corner of the slip. The step assembly includes a tread member for being mounted in the corner of the boat slip below the level of the upper surface of the boat dock. The tread member has a first edge portion for being secured to the first dock section of the boat dock, and a second edge portion for being secured to the second dock section of the boat dock. In one embodiment the tread member also defines a rear edge portion that, in cooperation with the first and second dock sections, defines an opening between the tread member and boat dock to accommodate a service or utility pole, or a dock support.

The deck assembly also includes a first riser member extending upwardly from the first edge portion of the tread member, the first riser member being provided with a first supporting flange for extending over the upper surface of the first dock section to facilitate the securing of the step assembly to the boat dock. Further, the deck assembly also includes a second riser member extending upwardly from the second edge portion of the tread member, the second riser member being provided with a second supporting flange for extending over the upper surface of the second dock section to facilitate the securing of the step assembly to the boat dock. In one embodiment the step assembly is also provided with a third riser member extending upwardly from the rear edge portion of the tread member, with the third riser member being provided with a third support flange extending substantially horizontally from an upper edge of the third riser member. Further, the step assembly can be provided with a handrail to facilitate movement of an individual from the boat dock to a boat moored in the boat slip.

BRIEF DESCRIPTION OF THE SEVERAL VIEWS OF THE DRAWINGS

The above-mentioned features of the invention will become more clearly understood from the following detailed description of the invention read together with the drawings in which.

DETAILED DESCRIPTION OF THE INVENTION

Figure 1:
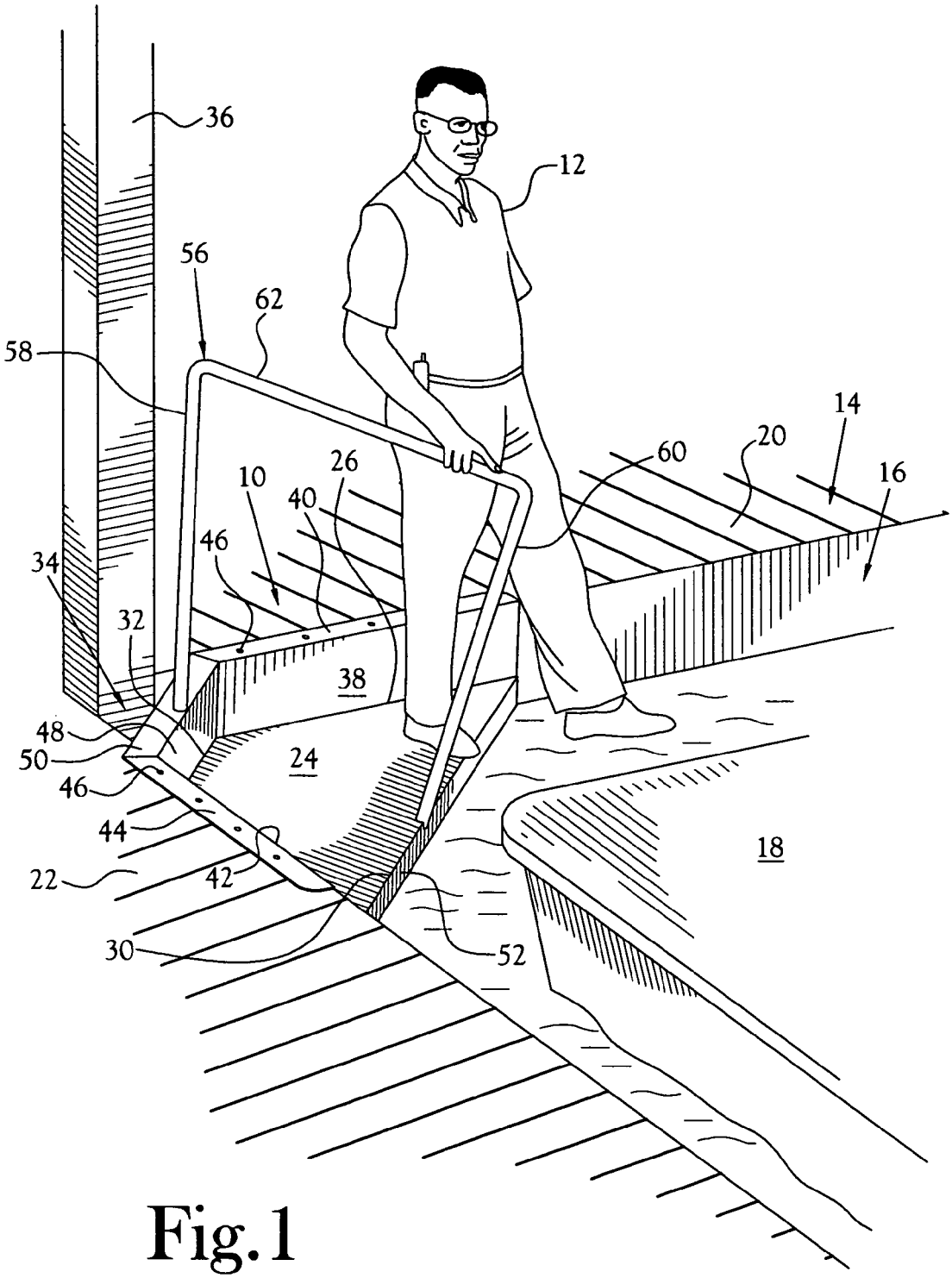
FIG. 1 is a perspective view of a boat slip step assembly in accordance with the present invention as it is mounted in the corner portion of a boat slip.
Figure 2:
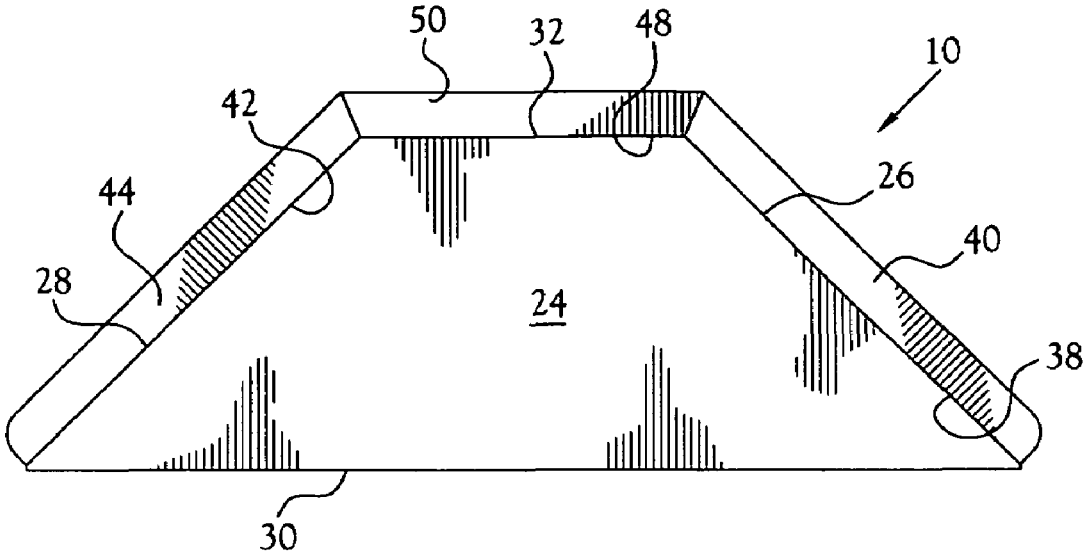
FIG. 2 is a top plan view of a boat slip step assembly in accordance with the present invention.

A boat slip step assembly in incorporating various features of the present invention is illustrated generally at 10 in FIGS. 1–4. The step assembly 10 is designed to facilitate movement of an individual 12 from a boat dock 14 defining a boat slip 16 onto a boat 18 docked in the slip 16, and to facilitate the movement of an individual 12 from a boat 18 to the dock 14. The assembly 10 can also be used to facilitate the entry of an individual into the water, and the individuals exit from the water, as in the case where an individual is swimming in the proximity of the dock. In this regard, those skilled in the art will recognize that boat slips, such as the boat slip 16, are typically defined by a boat dock having at least a first dock section 20 and a second dock section 22 which generally cooperate to define a corner of the slip 16. Further, the boat dock 14 can include a third section (not shown) such that the slip is defined by dock sections on three sides. As will be discussed in detail below, the boat slip step assembly 10 is mounted in the boat slip 16 so as to extend between the first dock section 20 and the second dock section 22.

In the illustrated embodiment of FIGS. 1–4, the assembly 10 includes at least one tread member 24 that is mounted below the level of the upper surface of the dock 14 and which extends between the first dock section 20 and the second dock section 22. More specifically, the tread member 24 defines a first edge portion 26 that is secured to the first dock section 20 and a second edge portion 28 that is secured to the second dock section 22. It will be noted that in the illustrated embodiment the tread member 24 defines a trapezoidal shape having a front edge portion 30 and a shorter rear edge portion 32, with the first and second edge portions 26 and 28 extending between the front and rear edge portions 30 and 32, respectively. One advantage to this trapezoidal configuration is that an opening 34 is defined between the rear edge portion 32 and the dock 14 that can accommodate a dock or roof support, or a service pole which provides electricity, water or other services to the slip. As illustrated in FIG. 1, the opening 34 provides a space through which the dock support 36 extends. It will, however, be understood by those skilled in the art that the tread member 24 could define various configurations. For example, where the opening 34 is not necessary, the tread member 24 could define a triangular configuration. Moreover, the front edge portion 30, and/or rear edge portion 32, could be arcuate or otherwise non-linear.

Those skilled in the art will recognize that various mechanisms could be used to secure the first edge portion 26 of the tread member 24 to the first dock section 20 and the second edge portion 28 of the tread member 24 to the second dock section 22. However, in one embodiment a first riser member 38 extends upward from the first edge portion 26 of the tread member 24. Whereas the first riser member 38 could be used as a securing flange to secure the assembly 10 to the first dock section 20, as by inserting screws or other fasteners through the riser member 38 and into the dock 14, in the illustrated embodiment, the first riser member 38 is provided with a supporting flange 40 that extends substantially horizontally to engage the upper surface of the dock section 20. Further, a second riser member 42 extends upward from the second edge portion 28 of the tread member 24. As with the first riser member 38, the second riser member 42 could be used to secure the assembly 10 to the second dock section 22. However, in the illustrated embodiment, the second riser member 42 is provided with a supporting flange 44 that extends substantially horizontally to engage the upper surface of the second dock section 22. As illustrated in FIG. 1, fasteners, such as the illustrated screws 46, can be used to secure the support flanges 40 and 44 to the docking 14, thereby securing the step assembly 10 in place in the corner of the slip 16.

Figure 3:
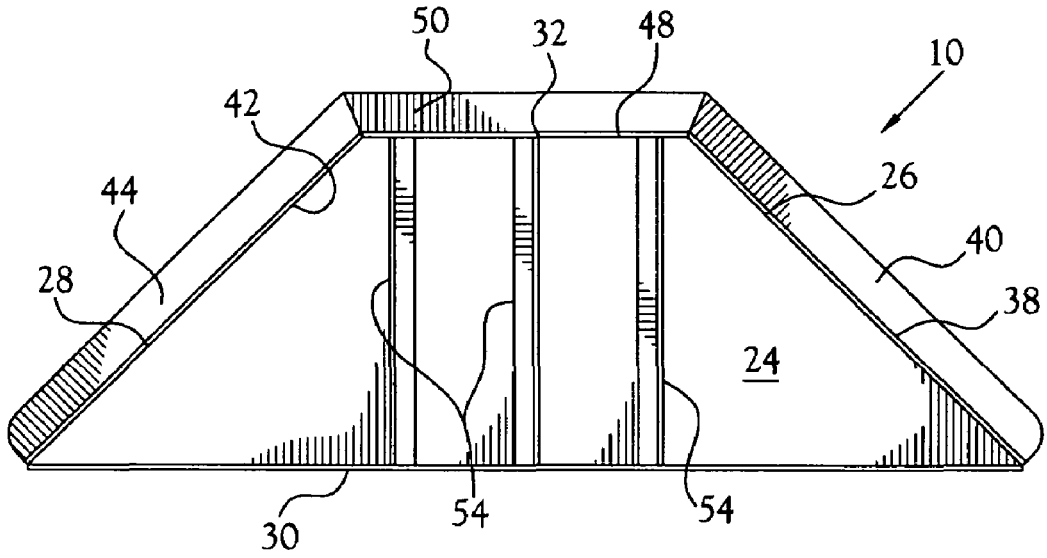
FIG. 3 is a bottom plan view of a boat slip step assembly in accordance with the present invention.

It will be noted that in the embodiment of the step assembly 10 in which the tread member 24 defines the rear edge portion 32, a third riser member 48 can be provided along with a further supporting flange 50. The third riser member 48 serves to prohibit an individual's foot and/or leg from accidentally slipping into the opening 34, and the further support flange serves to reinforce the rear portion of the assembly 10. It will also be noted that in one embodiment the front edge portion 30 of the tread member 24 is provided with a downwardly turned lip 52 that serves to strengthen and support the front edge portion 30 such that the weight of an individual 12 can be supported. Further, as illustrated in FIG. 3, reinforcement structures, such as the illustrated angle irons 54, can be secured to the underside of the tread member 24 to strengthen the tread member 24.

Figure 4:
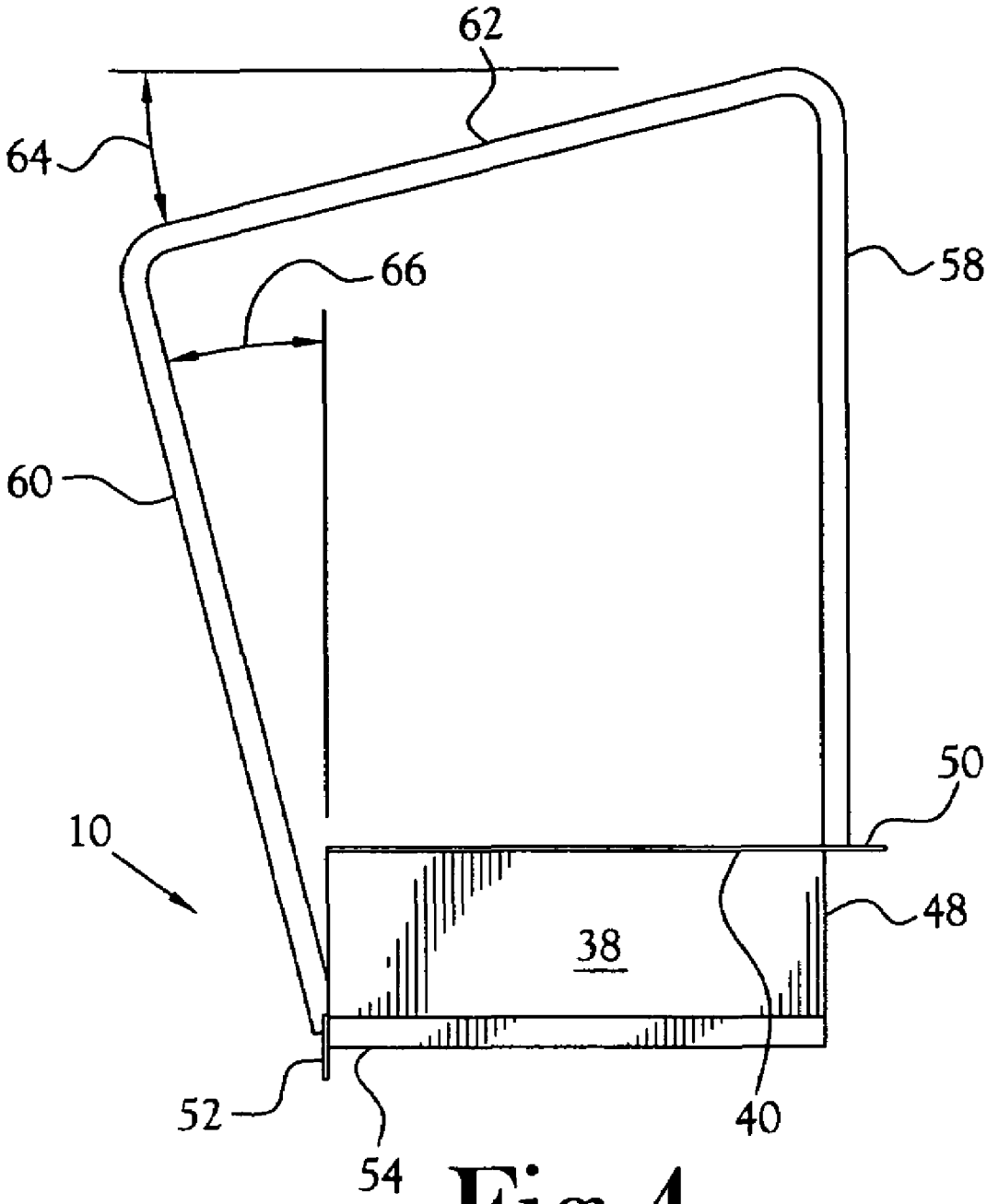
FIG. 4 is a side elevation view of a boat slip step assembly in accordance with the present invention.

In order to facilitate the safety of individuals using the step assembly 10, one embodiment of the assembly 10 is provided with a handrail 56. The handrail 56 includes a first support member 58 which is anchored to, and extends upwardly from, the further support flange 50, and a second support member 60 that is anchored to the assembly 10 at, or proximate, the front edge portion 30 of the tread member 24, and extends upwardly from the tread member 24. The handrail 56 also includes a grasping rail 62 which extends between the first support member 58 and the second support member 60. As illustrated in FIG. 4, in the preferred embodiment the grasping rail 62 angles downwardly a selected angle 64 from the first support member 58 to the second support member 60 to facilitate the grasping of the rail 62 as the individual moves between the level of the tread member 24 and the dock 14. Moreover, the second support member 60 angles outwardly from the tread member 24 a preselected angle 66 to allow the grasping rail 62 to extend beyond the front edge portion 30 of the tread member 24. It will be appreciated that extending the grasping rail 62 out into the slip 16 in this manner facilitates the supported movement of an individual 12 between the tread member 24 of the assembly 10 and a boat 18 moored in the slip 16.

The various components of the step assembly 10 are preferably fabricated of a strong durable metal such as steel, iron or aluminum, but various strong, durable materials could be used. In one embodiment the tread member 24, the riser members 38, 42, and 48, the support flanges 40, 44, and 50, and the lip 52, of the assembly 10 are made of diamond tread steel such that a non-slip surface is provided on exposed surfaces. However, various strong, durable materials having non-slip surfaces could be used, or the components of the assembly 10 could be coated or covered with non-slip materials.

Figure 5:
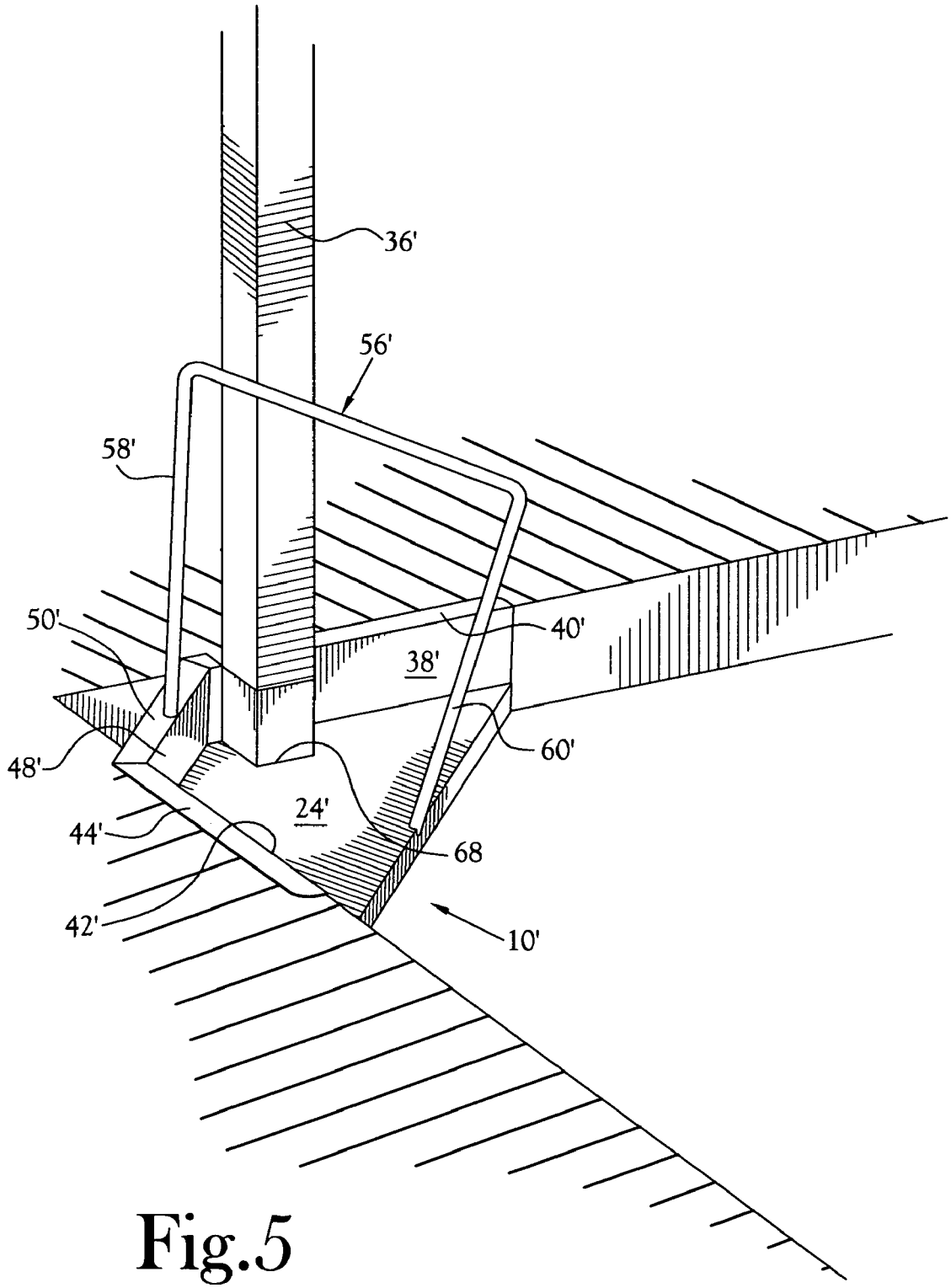
FIG. 5 is a perspective view of an alternative embodiment of a boat slip step assembly in accordance with the present invention.

In FIG. 5 an alternate embodiment of the boat slip step assembly of the present invention is illustrated generally at 10'. Components of the step assembly 10' that are common to the step assembly 10 described above will be referenced with common prime numbers. It will be noted that the tread member 24' of the step assembly 10' is provided with a notch 68 that provides an opening to accommodate a service pole or dock support. Further, in the one embodiment the first riser member 38' is configured to follow the edges of the notch 68 so as to form a protective wall around the edges of the notch 68 to prohibit an individual's foot and/or leg from accidentally being inserted into the opening defined by the notch 68. It will be understood by those skilled in the art that the placement of the notch 68 in the tread member 24' will vary depending upon the location of service poles or dock supports. Moreover, it may be necessary to provide more than one notch 68 to accommodate various dock structures.

In light of the above, it will be recognized that the boat slip step assembly 10, 10' provides great advantages over the prior art. The step assembly 10, 10' provides a convenient structure for facilitating the movement of an individual between the dock 14 and the boat 18, and also provides a structure to facilitate entry into, and exit from, the water as when individuals are swimming proximate the dock. It will also be recognized that the step assembly 10, 10' can also be used as a platform to provide greater access to the boat 18 when the boat 18 is being worked on. Moreover, because of the placement of the step assembly 10, 10' in the corner of a slip, very little usable slip space is lost when the assembly is used.

While the present invention has been illustrated by description of several embodiments and while the illustrative embodiments have been described in considerable detail, it is not the intention of the applicant to restrict or in any way limit the scope of the appended claims to such detail. Additional advantages and modifications will readily appear to those skilled in the art. The invention in its broader aspects is therefore not limited to the specific details, representative apparatus and methods, and illustrative examples shown and described. Accordingly, departures may be made from such details without departing from the spirit or scope of applicant's general inventive concept.

What is claimed is:

1. A boat slip step assembly for being mounted proximate the corner of a boat slip defined by a boat dock having at least first and second dock sections that cooperatively define a corner of the slip, the boat dock defining an upper surface, said step assembly comprising a tread member for being fixedly mounted below the level of the upper surface of the boat dock, said tread member having a first edge portion for being secured to the first dock section of the boat dock, and having a second edge portion for being secured to the second dock section of the boat dock, whereby said tread member is disposed within said corner defined by said first and second dock sections.

2. The boat slip step assembly of claim 1 where said step assembly includes a first riser member extending upward from said first edge portion of said tread member.

3. The boat slip step assembly of claim 1 wherein said step assembly includes a first riser member extending upward from said first edge portion of said tread member, and includes a second riser member extending upward from said second edge portion of said tread member.

4. The boat slip step assembly of claim 1 wherein said step assembly includes a hand rail.

5. A boat slip step assembly for being mounted proximate the corner of a boat slip defined by a boat dock having at least first and second dock sections that cooperatively define a corner of the slip, the boat dock defining an upper surface said step assembly comprising a tread member for being mounted below the level of the upper surface of the boat dock, said tread member having a first edge portion for being secured to the first dock section of the boat dock, and having a second edge portion for being secured to the second dock section of the boat dock, wherein said step assembly includes a first riser member extending upward from said first edge portion of said tread member, and includes a second riser member extending upward from said second edge portion of said tread member, wherein said first riser member is provided with a first supporting flange for extending over the upper surface of the boat dock, and wherein said second riser member is provided with a second supporting flange for extending over the upper surface of the boat dock, whereby said first and second supporting flanges support said step assembly on the upper surface of the boat dock.

6. The boat slip step assembly of claim 5 wherein said step assembly includes a hand rail.

7. A boat slip step assembly for being mounted proximate the corner of a boat slip defined by a boat dock having at least first and second dock sections that cooperatively define a corner of the slip, the boat dock defining an upper surface, said step assembly comprising a tread member for being mounted below the level of the upper surface of the boat dock, said tread member having a first edge portion for being secured to the first dock section of the boat dock, and having a second edge portion for being secured to the second dock section of the boat dock, wherein said tread member defines a rear edge portion that, in cooperation with the first and second dock sections, defines an opening.

8. A boat slip step assembly for being mounted proximate the corner of a boat slip defined by a boat dock having at least first and second dock sections that cooperatively define a corner of the slip, the boat dock defining an upper surface, said step assembly comprising a tread member for being mounted below the level of the upper surface of the boat dock, said tread member having a first edge portion for being secured to the first dock section of the boat dock, and having a second edge portion for being secured to the second dock section of the boat dock, wherein said step assembly includes a first riser member extending upward from said first edge portion of said tread member, and includes a second riser member extending upward from said second edge portion of said tread member, and, wherein said tread member defines a rear edge portion that, in cooperation with the first and second dock sections, defines an opening, and wherein said step assembly includes a third riser member extending upwardly from said rear edge portion of said tread member.

9. A boat slip step assembly for being mounted proximate the corner of a boat slip defined by a boat dock having at least first and second dock sections that cooperatively define a corner of the slip, the boat dock defining an upper surface, said step assembly comprising a tread member for being fixedly mounted below the level of the upper surface of the boat dock, said tread member having a first edge portion for being secured to the first dock section of the boat dock, and having a second edge portion for being secured to the second dock section of the boat dock wherein said tread member has a front edge portion and a rear edge portion and defines a substantially trapezoidal shape.

10. A boat slip step assembly for being mounted proximate the corner of a boat slip defined by a boat dock having at least first and second dock sections that cooperatively define the corner of the slip, the boat dock defining an upper surface, said step assembly comprising:

a tread member for being mounted in a corner of the boat slip below the level of the upper surface of the boat dock, said tread member having a first edge portion for being secured to the first dock section, and having a second edge portion for being secured to the second dock section of the boat dock;

a first riser member extending upwardly from said first edge portion of said tread member, said first riser member being provided with a first supporting flange for extending over an upper surface of the first dock section; and a second riser member extending upwardly from said second edge portion of said tread member, said second riser member being provided with a second supporting flange for extending over an upper surface of the second dock section.

11. The boat slip step assembly of claim 10 wherein said tread member defines a rear edge portion that, in cooperation with the first and second dock sections defines an opening between said step assembly and the boat dock, and wherein said step assembly includes a third riser member extending upwardly from said rear edge portion of said tread member.

12. The boat slip step assembly of claim 11 wherein said third riser member defines an upper edge provided with a third supporting flange, and wherein said step assembly includes a hand rail having a first support member anchored to, and extending upwardly from, said third supporting flange, and a second support member anchored to and extending upwardly from said tread member, said hand rail also including a grasping rail extending between said first support member and said second support member.

13. The boat slip step assembly of claim 12 wherein said grasping rail is angled downwardly from said first support member to said second support member.

14. The boat slip step assembly of claim 13 wherein said second support member angles outwardly from said tread member such that said grasping rail extends beyond said tread member in the direction of the boat slip.

15. The boat slip step assembly of claim 10 wherein said first edge portion of said tread member defines a notch that provides an opening between said tread member and the first dock section.

16. The boat slip step assembly of claim 15 wherein said first riser member is configured to follow the edges of said tread member defining said notch so as to form a wall bordering said notch.

17. The boat slip step assembly of claim 10 wherein said tread member has a front edge portion and a rear edge portion, and defines a substantially trapezoidal shape.

18. The boat slip step assembly of claim 10 wherein said step assembly includes a hand rail.

19. A boat slip step assembly for being mounted proximate the corner of a boat slip defined by a boat dock having at least first and second dock sections that cooperatively define a the corner of the slip, the boat dock defining an upper surface, said step assembly comprising:

a tread member for being mounted in a corner of the boat slip below the level of the upper surface of the boat dock, said tread member having a first edge portion for being secured to the first dock section, and having a second edge portion for being secured to the second dock section of the boat dock, said tread member defining a rear edge portion that, in cooperation with the first and second dock sections defines an opening between said tread member and the boat dock;

a first riser member extending upwardly from said first edge portion of said tread member, said first riser member being provided with a first supporting flange for extending over an upper surface of the first dock section;

a second riser member extending upwardly from said second edge portion of said tread member, said second riser member being provided with a second supporting flange for extending over an upper surface of the second dock section;

a third riser member extending upwardly from said rear edge portion of said tread member, said third riser being provided with a third supporting flange extending substantially horizontally from an upper edge of said third riser; and a handrail, said handrail having a first support member anchored to, and extending upwardly from, said third supporting flange, and a second support member anchored to, and extending from, said tread member proximate a front edge portion of said tread member, said hand rail also including a grasping rail extending between said first support member and said second support member.

20. The boat slip step assembly of claim 19 wherein said grasping rail is angled downwardly from said first support member to said second support member, and wherein said second support member angles outwardly from said tread member such that said grasping rail extends beyond said tread member in the direction of the boat slip.

* * * * *